US008876669B2

(12) United States Patent
Vujicic

(10) Patent No.: US 8,876,669 B2
(45) Date of Patent: Nov. 4, 2014

(54) EXERCISE CYCLE WITH PLANETARY GEAR SYSTEM AND ROLLING RECOILED LATERAL MOTION SYSTEM

(75) Inventor: Marko Vujicic, Huntington Beach, CA (US)

(73) Assignee: Shinn Fu Corporation, Taipei (TW)

( * ) Notice: Subject to any disclaimer, the term of this patent is extended or adjusted under 35 U.S.C. 154(b) by 309 days.

(21) Appl. No.: 13/106,497

(22) Filed: May 12, 2011

(65) Prior Publication Data

US 2011/0281694 A1 Nov. 17, 2011

Related U.S. Application Data

(60) Provisional application No. 61/334,396, filed on May 13, 2010.

(51) Int. Cl.

| | |
|---|---|
| ***A63B 22/00*** | (2006.01) |
| ***A63B 22/06*** | (2006.01) |
| ***A63B 69/16*** | (2006.01) |
| ***A63B 21/22*** | (2006.01) |

(52) U.S. Cl.

CPC ..... *A63B 22/0605* (2013.01); *A63B 2225/09* (2013.01); *A63B 2022/0658* (2013.01); *A63B 2022/0688* (2013.01); *A63B 2022/0611* (2013.01); *A63B 2022/0641* (2013.01); *A63B 22/0015* (2013.01); *A63B 22/0664* (2013.01); *A63B 21/225* (2013.01); *A63B 225/093* (2013.01)

USPC ..... 482/63; 482/57; 482/61

(58) Field of Classification Search

USPC ..... 482/51–78; 475/11, 165, 169, 183, 475/267–268, 338, 342, 349; 74/10.52, 74/433.5, 594.2; 477/69

See application file for complete search history.

(56) References Cited

U.S. PATENT DOCUMENTS

| | | | | |
|---|---|---|---|---|
| 3,964,742 | A | 6/1976 | Carnielli | |
| 4,272,094 | A | 6/1981 | Patrin | |
| 4,309,043 | A | 1/1982 | Brown | |
| 4,452,445 | A * | 6/1984 | Csekes | 482/63 |
| 4,632,386 | A | 12/1986 | Beech | |
| 4,712,806 | A | 12/1987 | Patrin | |
| 4,809,970 | A * | 3/1989 | Beistegui | 482/64 |
| 4,880,224 | A | 11/1989 | Jonas et al. | |
| 5,031,902 | A | 7/1991 | Findlay | |
| 5,480,366 | A | 1/1996 | Harnden et al. | |
| 6,119,840 | A | 9/2000 | Dettmar | |

(Continued)

FOREIGN PATENT DOCUMENTS

| | | | |
|---|---|---|---|
| CN | 2061548 U | * | 9/1990 |
| WO | WO 2010118899 A1 | * | 10/2010 |

*Primary Examiner* — Loan H Thanh
*Assistant Examiner* — Joshua Lee

(57) ABSTRACT

A planetary gear system in an exercise machine featuring a flywheel; an axle shaft positioned through the center of the flywheel, a sun gear disposed on the axle shaft and fixedly attached to the flywheel, a housing disposed on the axle shaft, a planet carrier fixedly attached to the axle shaft and disposed in the housing, and a ring gear fixedly attached in the housing. One or more planet gear wheels are rotatably attached to the planet carrier. The planet gear wheels can rotate independently of the planet carrier. Rotation of the axle shaft in a first direction rotates the planet carrier in the first direction, thereby causing the planet gear wheel to rotate in a second direction within the ring gear. Rotation of the planet gear wheel in the second direction causes the sun gear and the flywheel to together rotate in the first direction.

3 Claims, 13 Drawing Sheets

(56) References Cited

U.S. PATENT DOCUMENTS

| | | | | |
|---|---|---|---|---|
| 7,163,491 | B2 | 1/2007 | Rufino | |
| 7,704,192 | B2 | 4/2010 | Dyer et al. | |
| 7,927,258 | B2 | 4/2011 | Irving et al. | |
| 2002/0077221 | A1* | 6/2002 | Dalebout et al. | 482/57 |
| 2005/0245347 | A1* | 11/2005 | Liang | 475/331 |
| 2006/0217237 | A1 | 9/2006 | Rhodes et al. | |
| 2007/0275811 | A1 | 11/2007 | Starik | |
| 2008/0051258 | A1 | 2/2008 | Schmehl et al. | |
| 2009/0036276 | A1 | 2/2009 | Loach | |
| 2009/0170667 | A1 | 7/2009 | Irving et al. | |

* cited by examiner

EXERCISE CYCLE WITH PLANETARY GEAR SYSTEM AND ROLLING RECOILED LATERAL MOTION SYSTEM

CROSS REFERENCE

This application claims priority to U.S. provisional application Ser. No. 61/334,396 filed May 13, 2010, the specification of which is incorporated herein by reference in its entirety.

FIELD OF THE INVENTION

The present invention is directed to a planetary gear system, for example a planetary gear system for use in exercise equipment.

BACKGROUND OF THE INVENTION

Standard stationary bicycles generally comprise a direct drive system, for example a chain drive system or a belt drive system. Generally, the main crank consists of a one- or three-piece crank that is attached to a toothed chain gear or to a belt pulley. The crank additionally provides threaded mount points such that pedals can be mounted to the ends of the crank arms. The pedals are also oriented such that they are parallel to the floor. The toothed chain gear or belt pulley is then attached via a chain or a belt to the smaller toothed chain gear or timing belt pulley, which is attached to the primary bicycle flywheel. The flywheel can be mounted either in front or behind the main crank by a distance greater than the radius of the heel. The flywheel typically has a mass of about 45 pounds.

The present invention features a novel planetary gear system and a rolling recoiled lateral motion system for use in machines such as exercise equipment, for example a stationary bicycle system. However, the systems of the present invention are not limited to exercise equipment (e.g., stationary bicycle systems, spinning machines, rowing machines, abdominal machines, and the like). The novel planetary gear system of the present invention allows for the crank and flywheel to be integrated into a single assembly. Advantages of the planetary gear system of the present invention are discussed herein. The rolling recoiled lateral motion system allows for lateral, side-to-side, and rolling motion to be achieved, which feels similar to the natural motions when riding a bicycle into a turn or when standing up (e.g., for a sprint).

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

SUMMARY

The present invention features a novel planetary gear system and a rolling recoiled lateral motion system for use in machines such as exercise equipment, for example a stationary bicycle system. In some embodiments, the planetary gear system comprises a flywheel and an axle shaft disposed through the center of the flywheel. The axle shaft has a first end and a second end, and a first crank is fixedly attached to the first end and a second crank is fixedly attached to the second end of the axle shaft. The flywheel rotates independently of the axle shaft. A sun gear is disposed on the axle shaft and fixedly attached to the flywheel. The sun gear rotates independently of the axle shaft. A housing is disposed on the axle shaft in between the flywheel and the second crank (or first crank). The axle shaft rotates independently of the housing. A planet carrier is fixedly attached to the axle shaft and disposed in the housing, and a ring gear is fixedly attached in the housing. One or more planet gear wheels are rotatably attached to the planet carrier via planet gear wheel axles. The planet gear wheels can rotate independently of the planet carrier.

In some embodiments, the outer surface of the planet gear wheel engages both an inner surface of the ring gear and an outer surface of the sun gear. Rotation of the axle shaft in a first direction via the cranks in turn rotates the planet carrier in the first direction, thereby causing the planet gear wheel to rotate in a second direction within the ring gear. Rotation of the planet gear wheel in the second direction causes the sun gear and the flywheel to together rotate in the first direction.

In some embodiments, the planet gear wheel comprises a small planet gear wheel fixed to a large planet gear wheel, wherein the planet gear wheel axle connects to the center of the small planet gear wheel and the center of the large planet gear wheel. The small planet gear wheel has a diameter smaller than that of the large planet gear wheel. The small planet gear wheel engages the ring gear and the large planet gear wheel engages the sun gear. Rotation of the axle shaft in a first direction via the cranks in turn rotates the planet carrier in the first direction, thereby causing each small planet gear wheel to rotate in a second direction within the ring gear and each large planet gear wheel to rotate in the second direction about the sun gear, thereby causing the sun gear and the flywheel to together rotate in the first direction.

In some embodiments, the system comprises a first planet gear wheel, a second planet gear wheel, and a third planet gear wheel. In some embodiments, the planet gear wheels are arranged asymmetrically on the planet carrier. In some embodiments, the planet gear wheels are arranged symmetrically on the planet carrier. In some embodiments, each large planet gear wheel has a set of teeth disposed on an outer edge that engage a set of teeth disposed on an outer edge of the sun gear. In some embodiments, the planet gear wheel engages the sun gear via friction. In some embodiments, each small planet gear wheel has a set of teeth disposed on an outer edge that engage a set of teeth disposed on an inner edge of the ring gear. In some embodiments, the planet gear wheel engages the ring gear via friction.

In some embodiments, the flywheel rotates about the axle shaft via first rotational bearings (e.g., ball bearing, a plain bearing, a needle bearing, etc.). In some embodiments, the axle shaft rotates within the housing via second bearings (e.g., a ball bearing, a plain bearing, a needle bearing, etc.).

In some embodiments, the system has a speed increase ratio of at least 1:1. In some embodiments, the system has a speed increase ratio of about 2:1. In some embodiments, the system has a speed increase ratio of about 5:1. In some embodiments, the system has a speed increase ratio of about 8:1. In some embodiments, the system has a speed increase ratio of about 10:1. In some embodiments, the system has a speed increase ratio of about 12:1. In some embodiments, the system has a speed increase ratio of about 15:1. In some embodiments, the system has a speed increase ratio of about 20:1.

In some embodiments, the housing is fixed in a bicycle frame. In some embodiments, the bicycle frame further comprises a first extension extending from a vertex adapted to support a handlebar system. In some embodiments, the bicycle frame further comprises a second extension extending from the vertex adapted to support a seat system.

The present invention also features an exercise equipment comprising an axle shaft having a first end with a first crank and a second end with a second crank, and a planet carrier fixedly attached to the axle shaft and coaxial to the axle shaft.

In some embodiments, the exercise equipment further comprises a flywheel coaxial to the cranks and axle shaft. In some embodiments, the equipment is integrated into a bicycle machine. In some embodiments, the equipment is integrated into a rowing machine. In some embodiments, the equipment is integrated into an elliptical trainer machine. In some embodiments, the equipment is integrated into a hand-driven cycle machine. In some embodiments, the equipment is integrated into a treadmill machine.

The present invention also features a system (e.g., a pivot system) comprising a base; a rotational bearing attached to and offset from a plane of the base at an angle A; a bicycle frame having a lower extension extending from the vertex, wherein the rotational bearing rotatably engages the lower extension. The bicycle frame can rotate right or left with respect to the base. The system (e.g., pivot system) further comprises a recoil support mechanism adapted to limit rotational movement of the bicycle frame with respect to the base. The recoil support mechanism comprises a first bumper and a second bumper positioned on opposite sides of a recoil support gusset disposed on the bicycle frame. The bumpers can move between at least an extended position and a compressed position, wherein rotational movement of the bicycle frame causes the recoil support gusset to compress the bumpers to the compressed position, thereby causing the bumpers to push back against the recoil support gusset to limit rotational movement of the bicycle frame.

In some embodiments, the bumpers are replaced with springs. In some embodiments, the rotational bearing is attached to the base via a reinforced frame support. In some embodiments, the rotational bearing rotatably engages the lower extension of the bicycle frame via a sleeve in the lower extension of the bicycle frame. In some embodiments, the sleeve is a part of the base. In some embodiments, the shaft is a part of the base.

In some embodiments, angle A is between about 20 to 40 degrees. In some embodiments, angle A is between about 30 to 50 degrees. In some embodiments, angle A is between about 40 to 60 degrees.

The present invention also features an exercise system comprising the planetary gear system and a pivot system. The pivot system comprises a base; a rotational bearing attached to and offset from a plane of the base at an angle A; a bicycle frame having a lower extension extending from the vertex, wherein the rotational bearing rotatably engages the lower extension. The bicycle frame can rotate right or left with respect to the base. The planetary gear system is integrated into the bicycle frame. The pivot system further comprises a recoil support mechanism adapted to limit rotational movement of the bicycle frame with respect to the base. The recoil support mechanism comprises a first bumper and a second bumper positioned on opposite sides of a recoil support gusset disposed on the bicycle frame. The bumpers can move between at least an extended position and a compressed position, wherein rotational movement of the bicycle frame causes the recoil support gusset to compress the bumpers to the compressed position, thereby causing the bumpers to push back against the recoil support gusset to limit rotational movement of the bicycle frame.

DESCRIPTION OF PREFERRED EMBODIMENTS

Figure 1:
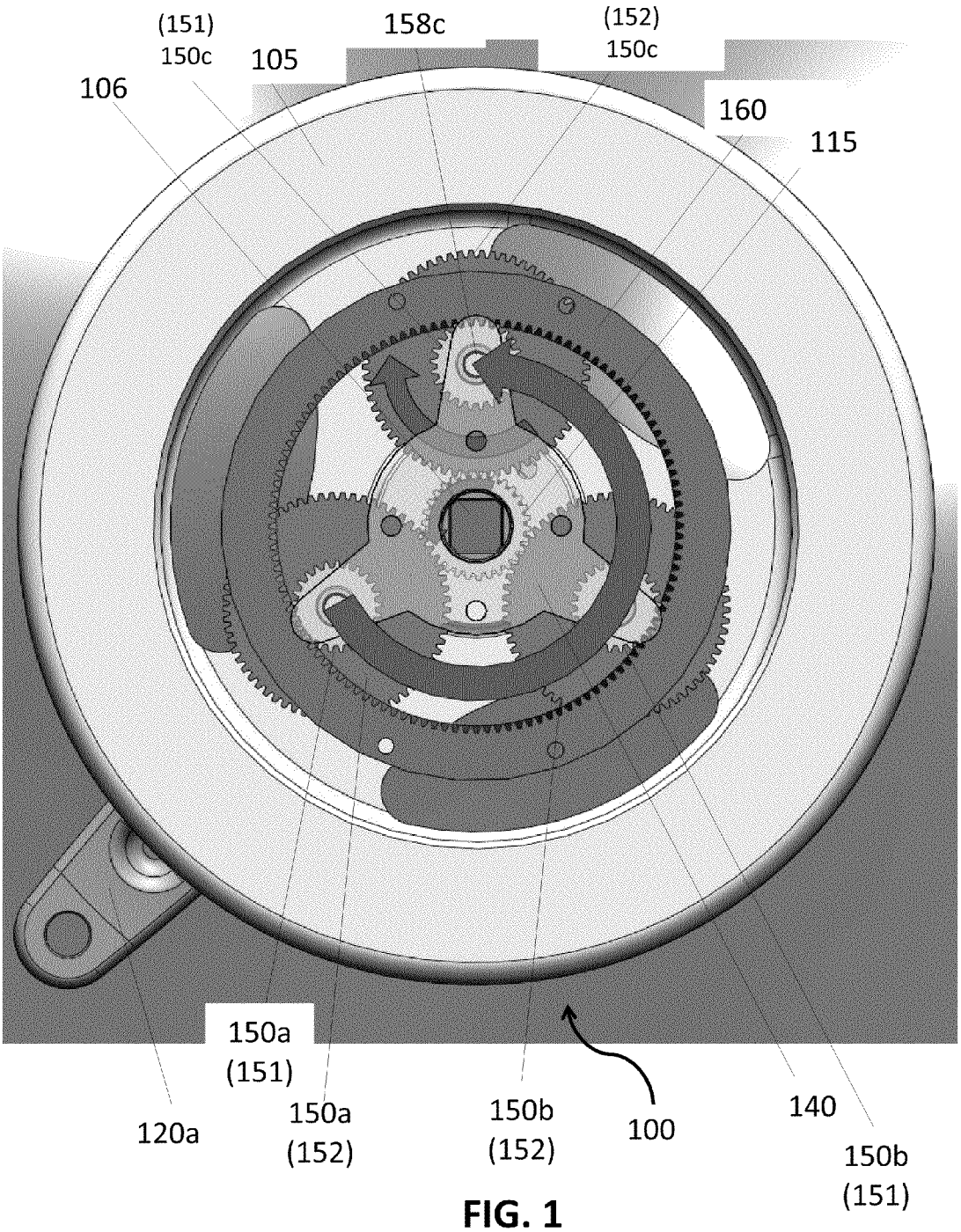
FIG. 1 is a side view of the planetary gear system of the present invention.
Figure 2:
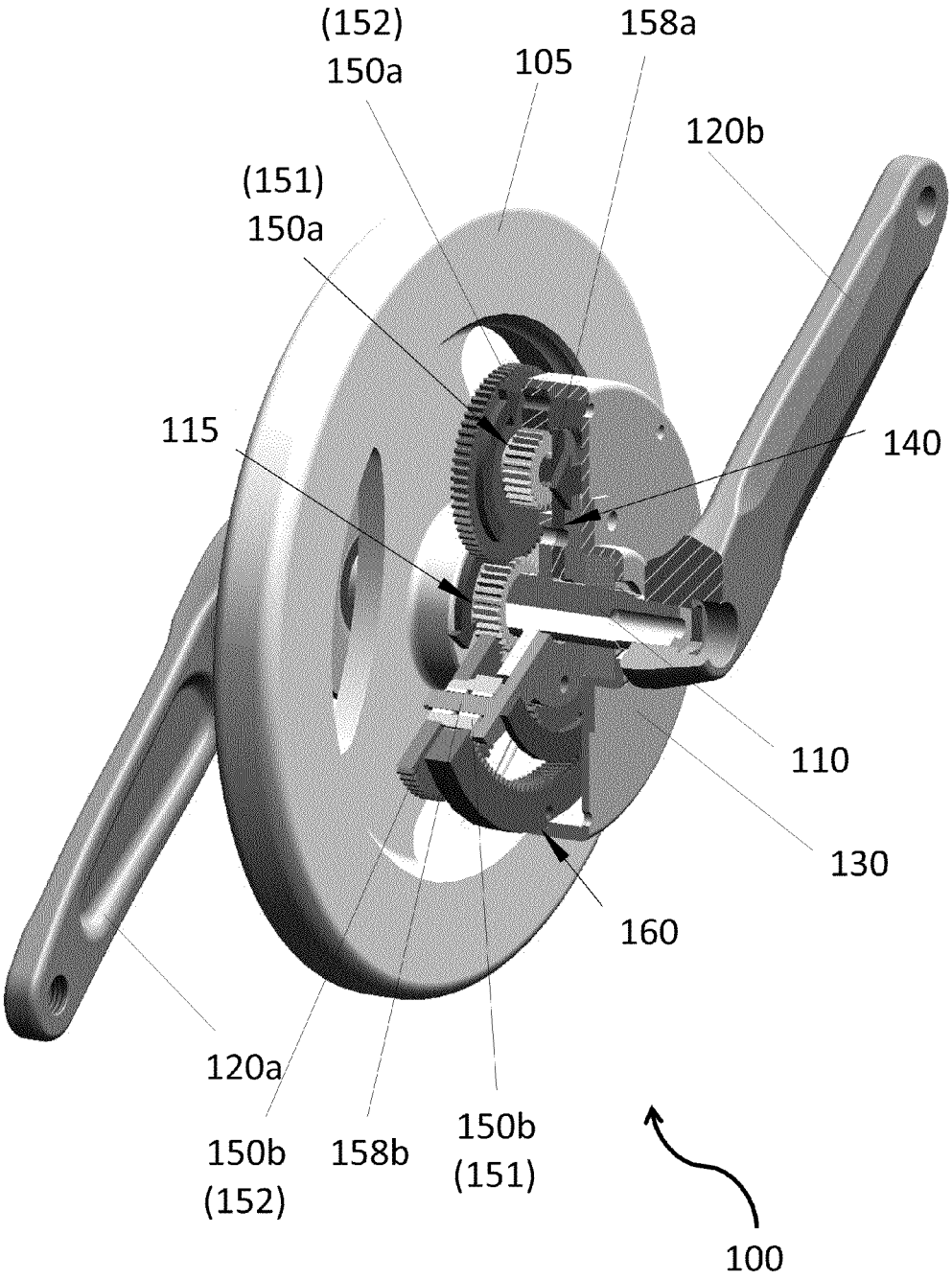
FIG. 2 is a side perspective view and partial cross sectional view of the planetary gear system of the present invention.
Figure 3A:
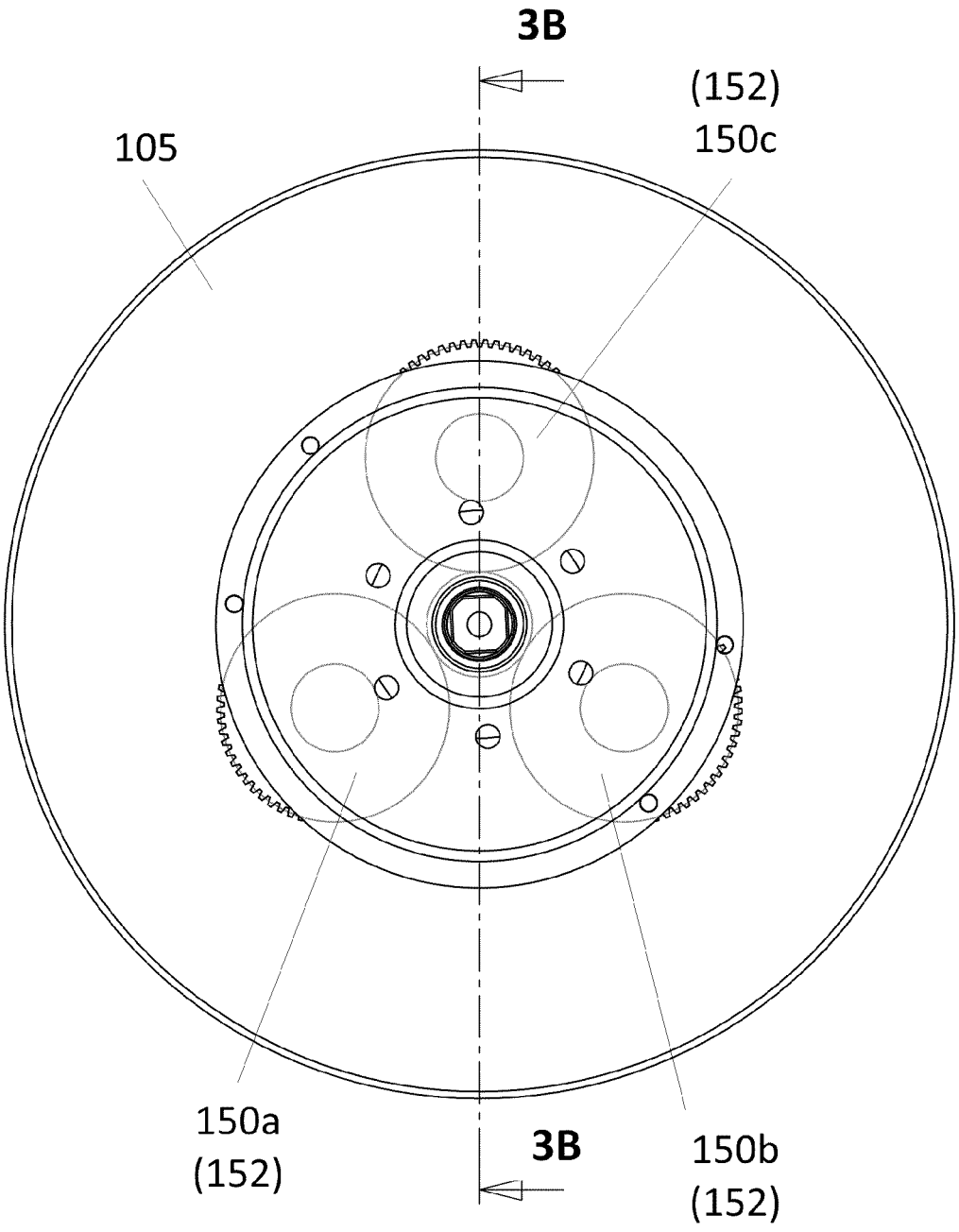
FIG. 3A is a side view of the planetary gear system of the present invention.
Figure 3B:
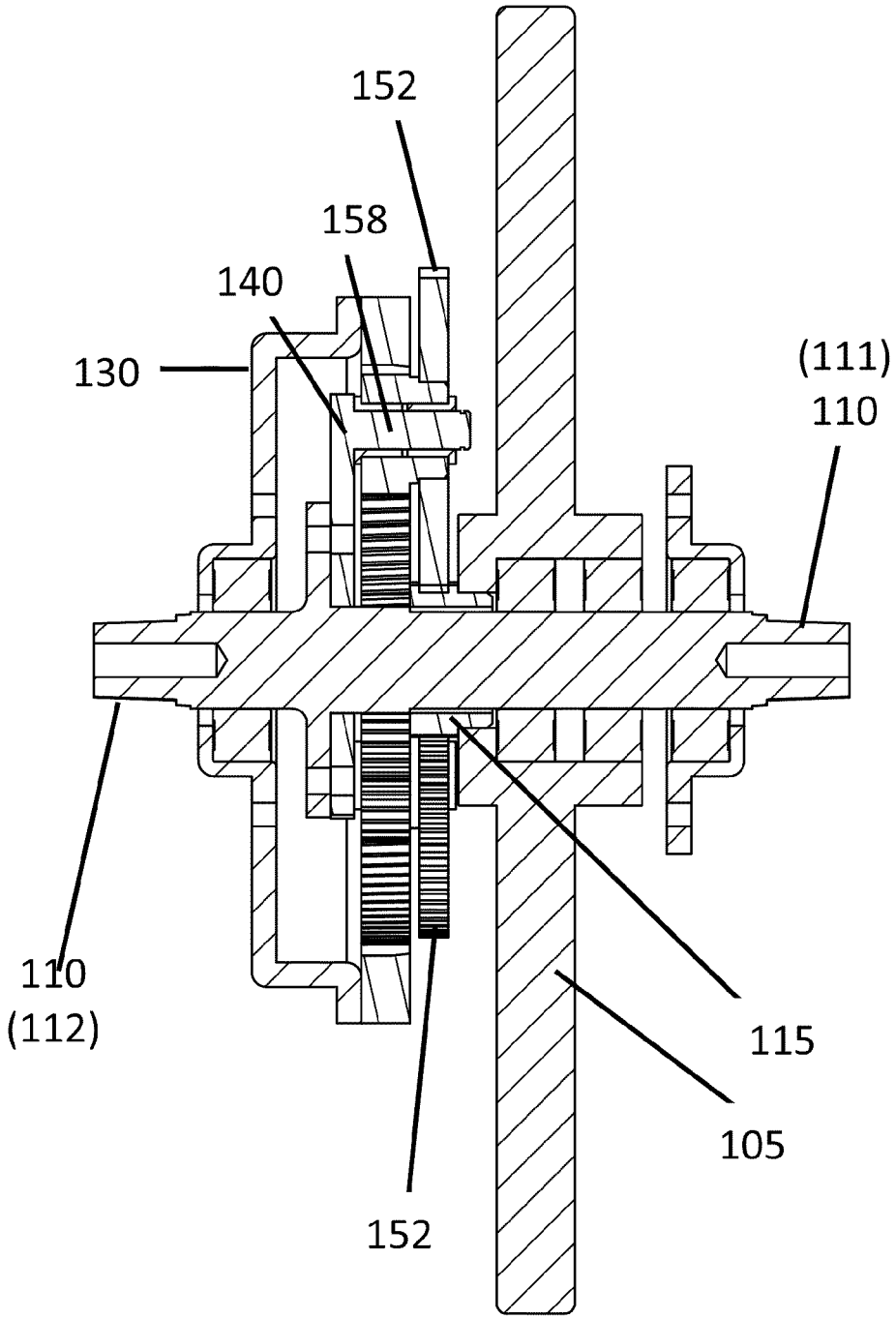
FIG. 3B is a cross sectional view of the planetary gear system of FIG. 3A.

Referring now to FIG. 1-12, the present invention features a novel planetary gear system and a rolling recoiled lateral motion system for use in machines such as exercise equipment, for example a stationary bicycle system. However, the systems of the present invention are not limited to exercise equipment (e.g., stationary bicycle systems, spinning machines, rowing machines, abdominal machines, and the like). The novel planetary gear system of the present invention allows for the crank and heel to be integrated into a single assembly.

Planetary Gear System

As shown in FIG. 1-4, the planetary gear system 100 comprises a flywheel 105. The flywheel 105 may resemble standard flywheels used in stationary bicycles, which are well known to one of ordinary skill in the art. The flywheel 105 is generally circular in shape (e.g., a flat circle, e.g., with an outer edge, a center 106, a first surface, and a second surface). In some embodiments, the flywheel also serves as a resistance means when a friction brake pad is applied to the outer surface of the spinning flywheel. This provides a greater resistance to the user, for workouts of varying and increased effort levels.

The flywheel 105 may be constructed in various sizes and weights. For example, in some embodiments, the flywheel 105 weighs between about 5 to 10 pounds. In some embodiments, the flywheel 105 weighs between about 10 to 15 pounds. In some embodiments, the flywheel 105 weighs between about 15 to 20 pounds. In some embodiments, the flywheel 105 weighs between about 20 to 25 pounds. In some embodiments, the flywheel 105 weighs between about 25 to 30 pounds. In some embodiments, the flywheel 105 weighs between about 30 to 35 pounds. In some embodiments, the flywheel 105 weighs between about 35 to 40 pounds. In some embodiments, the flywheel 105 weighs between about 40 to 45 pounds. In some embodiments, the flywheel 105 weighs between about 45 to 50 pounds. In some embodiments, the flywheel 105 weighs between about 50 to 55 pounds. In some embodiments, the flywheel 105 weighs between about 55 to 60 pounds. In some embodiments, the flywheel 105 weighs between about 60 to 65 pounds. In some embodiments, the flywheel 105 weighs more than about 65 pounds. The flywheel may practically weigh from 5 to 65 lbs, depending on the gear ratio selected and the inertial "feel" preferred in the design process. The present invention is not limited to the aforementioned flywheel weights.

In some embodiments, the flywheel 105 is between about 4 and 8 inches in diameter. In some embodiments, the flywheel 105 is between about 8 and 10 inches in diameter. In some embodiments, the flywheel 105 is between about 10 and 12 inches in diameter. In some embodiments, the flywheel 105 is between about 12 and 16 inches in diameter. In some embodiments, the flywheel 105 is between about 16 and 20 inches in diameter. In some embodiments, the flywheel 105 is more than 20 inches in diameter. In some embodiments, the flywheel 105 is less than 8 inches in diameter. The limits of the flywheel size are may be a function of the overall design of the exercise bike. The present invention is not limited to the aforementioned sizes of the flywheel 105.

Traversing the center 106 of the flywheel 105 is an axle shaft 110. The axle shaft 110 can rotate independently of the flywheel 105 (e.g., the axle shaft 110 and flywheel 105 are not fixedly attached). The axle shaft 110 has a first end 111 and a second end 112, wherein the first end 111 of the axle shaft 110 protrudes from the first surface of the flywheel 105 and the second end 112 of the axle shaft 110 protrudes from the second surface of the flywheel 105. A first crank 120*a* is disposed on the first end 111 of the axle shaft 110, and a second crank 120*b* is disposed on the second end 112 of the axle shaft 110.

A sun gear 115 is disposed (not fixedly) on the axle shaft. The sun gear 115 is fixedly attached to the flywheel 105. For example, the sun gear 115 has a center that aligns with the center 106 of the flywheel 105, and the axle shaft 110 traverses both the center 106 of the flywheel 105 and the center of the sun gear 115. Like the flywheel 105, the sun gear 115 rotates independently of the axle shaft 110 (e.g., the flywheel 105 and the sun gear 115 rotate together because the two are fixedly attached).

In some embodiments, a housing 130 is disposed on the axle shaft 110 in between the flywheel 105 and the second crank 120*b* (or the first crank 120*a*). The axle shaft 110 is not fixedly attached to the housing; the axle shaft 110 rotates independently of the housing 130. For example, the housing 130 remains fixed and the axle shaft 110 rotates in a first direction and/or a second direction with respect to the housing 130.

A planet carrier 140 is fixedly attached to the axle shaft 110 (and housed in the housing 130). The planet carrier 140 has a center and the axle shaft 110 traverses its center. Rotation of the axle shaft 110 in the first direction causes rotation of the planet carrier in the first direction, and rotation of the axle shaft 110 in the second direction causes rotation of the planet carrier 140 in the second direction. The planet carrier 140 may be constructed in a variety of shapes. For example, in some embodiments, the planet carrier 140 has a generally triangular shape (e.g., see FIG. 1). In some embodiments, the planet carrier 140 has a generally square/rectangular shape. In some embodiments, the planet carrier 140 has a generally pentagonal shape. In some embodiments, the planet carrier 140 has a generally circular shape. The planet carrier 140 is not limited to the aforementioned shapes.

A ring gear 160 is housed in the housing 130 and fixedly attached to the housing 130. In some embodiment, the ring gear 160 is positioned around the planet gear wheel 140, however the present invention is not limited to this configuration. For example, in some embodiments, the ring gear 160 is positioned around all or a portion of the planet gear wheels 150 that are disposed on the planet carrier 140.

The system 100 of the present invention further comprises planet gear wheels 150 disposed on the planet carrier 140. In some embodiments, the system 100 comprises one planet gear wheel 150. In some embodiments, the system 100 comprises two planet gear wheels 150. In some embodiments, the system 100 comprises three planet gear wheels 150. In some embodiments, the system 100 comprises four planet gear wheels 150. In some embodiments, the system 100 comprises five planet gear wheels 150. In some embodiments, the system 100 comprises six planet gear wheels 150. In some embodiments, the system 100 comprises seven planet gear wheels 150. In some embodiments, the system 100 comprises eight planet gear wheels 150. In some embodiments, the system 100 comprises nine planet gear wheels 150. In some embodiments, the system 100 comprises ten planet gear wheels 150. In some embodiments, the system 100 comprises more than ten planet gear wheels 150 (e.g., eleven, twelve, thirteen, fourteen, fifteen, sixteen, seventeen, eighteen, nineteen, twenty, more than twenty, etc.).

In some embodiments, the system 100 comprises three planet gear wheels 150. In some embodiments, a first planet gear wheel 150*a* is rotatably attached to a first position on the planet carrier 140 (e.g., via a first planet gear wheel axle 158*a*), a second planet gear wheel 150*b* is rotatably attached to a second position on the planet carrier 140 (e.g., via a second planet gear wheel axle 158*b*), and a third planet gear wheel 150*c* is rotatably attached to a third position on the planet carrier 140 (e.g., via a third planet gear wheel axle 158*c*). The planet gear wheels 150 are not fixedly attached to the planet carrier 140 and can rotate independently of the carrier 140. For example, the planet gear wheels 150 can rotate with respect to the carrier 140 about their respective planet gearwheel axles 158.

The planet gear wheels 150 may be arranged in any configuration on the planet carrier 140. In some embodiments, the planet gear wheels 150 are arranged asymmetrically on the planet carrier 140. In some embodiments, the planet gear wheels 150 are arranged and spaced symmetrically on the planet carrier 140. For example, the first position on the planet carrier 140 is equidistant from the second position and the third position on the planet carrier 140, and the second position on the planet carrier 140 is equidistant from the first position and the third position on the planet carrier 140 (e.g., see FIG. 1). The present invention is in no way limited to this configuration.

In some embodiments, each planet gear wheel 150 comprises a small planet gear wheel 151 fixed to a large planet gear wheel 152. However, the planet gear wheels 150 are not limited to this compound configuration. Each small planet gear wheel 151 and each large planet gear wheel 152 has a center, and the centers of small planet gear wheels 151 are aligned with the respective centers of the large planet gear wheels 152. The planet gear wheel axles 158 traverse the centers of its respective small planet gear wheel 151 and large planet gear wheel 152. The small planet gear wheels 151 are smaller than their respective large planet gear wheels 152, thus each small planet gear wheel 151 has a diameter that is smaller than that of its respective large planet gear wheel 152. In some embodiments, the compound gears may be replaced with single gears (e.g., single gears that engage and mesh with the sun gear and/or ring gear).

As shown in FIG. 1, each small planet gear wheel 151 engages the ring gear 160 (the inner surface of the ring gear 160) and each large planet gear wheel 152 engages the sun gear 115 (the outer surface of the sun gear 115). In some embodiments, each large planet gear wheel 152 has a set of teeth disposed on its outer edge (outer surface) that engage a set of teeth disposed on an outer edge (outer surface) of the sun gear 115. In some embodiments, each small planet gear wheel 151 has a set of teeth disposed on an outer edge (outer surface) that engage a set of teeth disposed on an inner edge (inner surface) of the ring gear 160. The present invention is not limited to engagement of the gears via teeth; for example, in some embodiments, the large planet gear wheels 152 engage the sun gear via friction; in some embodiments, the small planet gear wheels 151 engage the ring gear via friction.

When the axle shaft 110 is rotated in a first direction (via the cranks 120), the planet carrier 140 also rotates in the first direction (e.g., the planet carrier 140 is fixedly attached to the axle shaft 110). Rotation of the planet carrier 140 in the first direction causes each small planet gear wheel 151 to rotate in the second direction (opposite the first direction) within the ring gear 160 and each large planet gear wheel 152 to rotate in the second direction (opposite the first direction) about/around the sun gear 115. Rotation of the small planet gear wheels 151 and the large planet gear wheels 152 in the second direction causes the sun gear 115 and flywheel 105 to together rotate in the first direction (the flywheel 105 rotates in the same direction as the cranks 120).

Figure 4:
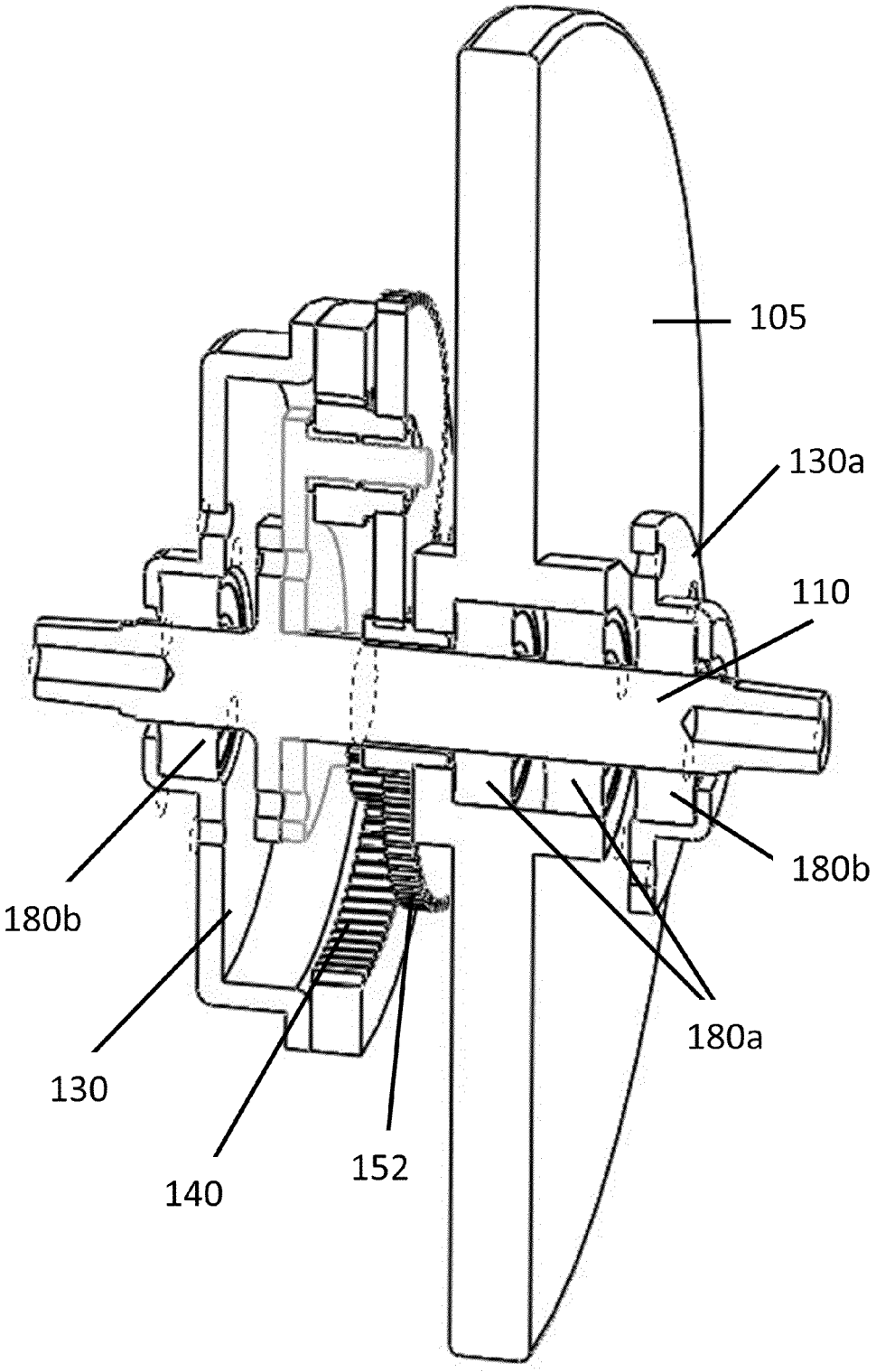
FIG. 4 is a perspective cross sectional view of the planetary gear system of the present invention.

In some embodiments, the flywheel 105 rotates about the axle shaft 110 via first ball bearings 180*a* (e.g., see FIG. 4). In some embodiments, the axle shaft 110 rotates within the housing 110 via second ball bearings 180*b* (e.g., see FIG. 4).

In some embodiments, a friction brake pad is mounted to the frame or housing. The friction brake pad may be pressed with a user adjustable force against the flywheel to provide braking resistance to the system, allowing the user to add and adjust resistance to the system and vary the amount of effort required to rotate the pedals. The brake pad or pads may be made of a suitable material such as felt or leather to provide a long wearing means of frictional braking action to any surface or surfaces of the flywheel. The brake pad or pads are not limited to this construction.

In some embodiments, a magnetic field may be applied to a metallic flywheel to induce a frictional drag via the eddy-current effect, for the same purpose. The magnetic field may be generated by permanent type magnets, or electro-magnets, or other type of magnet. Such magnets are well known to one of ordinary skill in the art. The amount of resistance force may be varied by adjusting the strength of the magnetic field, and/or the proximity of the magnetic field to the surface or surfaces of the flywheel.

Figure 10:
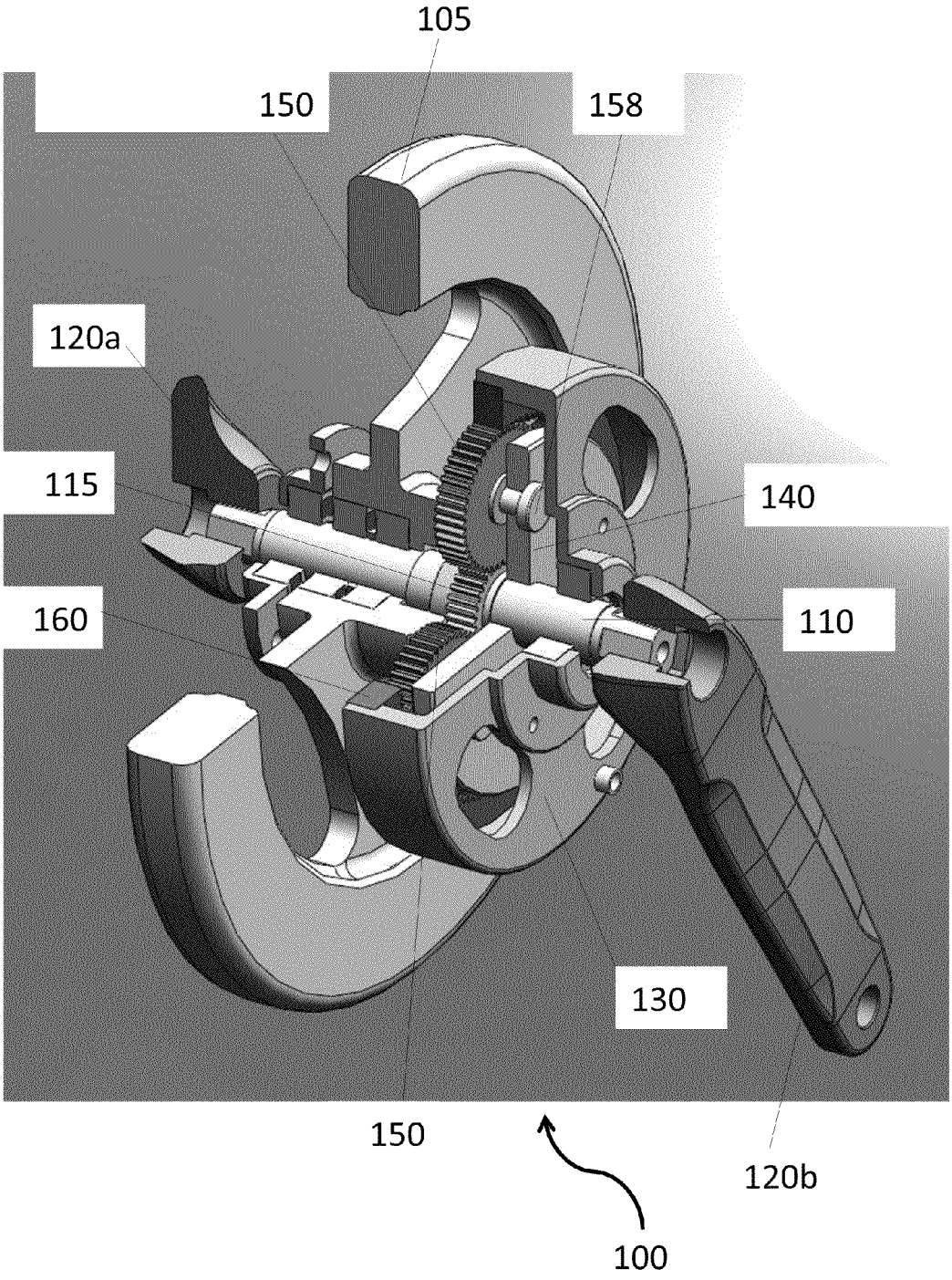
FIG. 10 is a side perspective view and partial cross sectional view of an alternative embodiment of the planetary gear system of the present invention.
Figure 11:
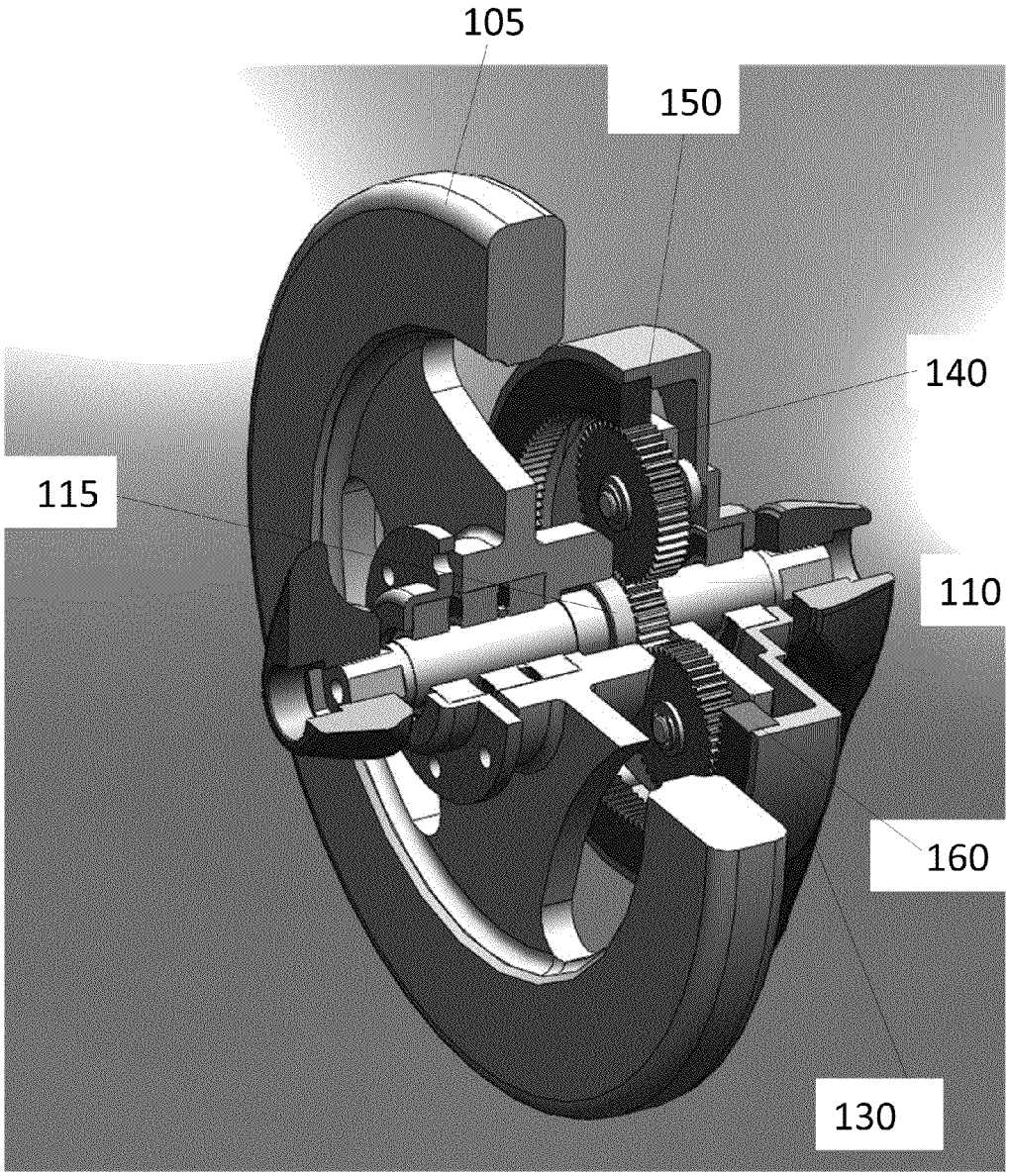
FIG. 11 is a reverse side perspective view and partial cross sectional view of the alternative embodiment of the planetary gear system of FIG. 10.
Figure 12:
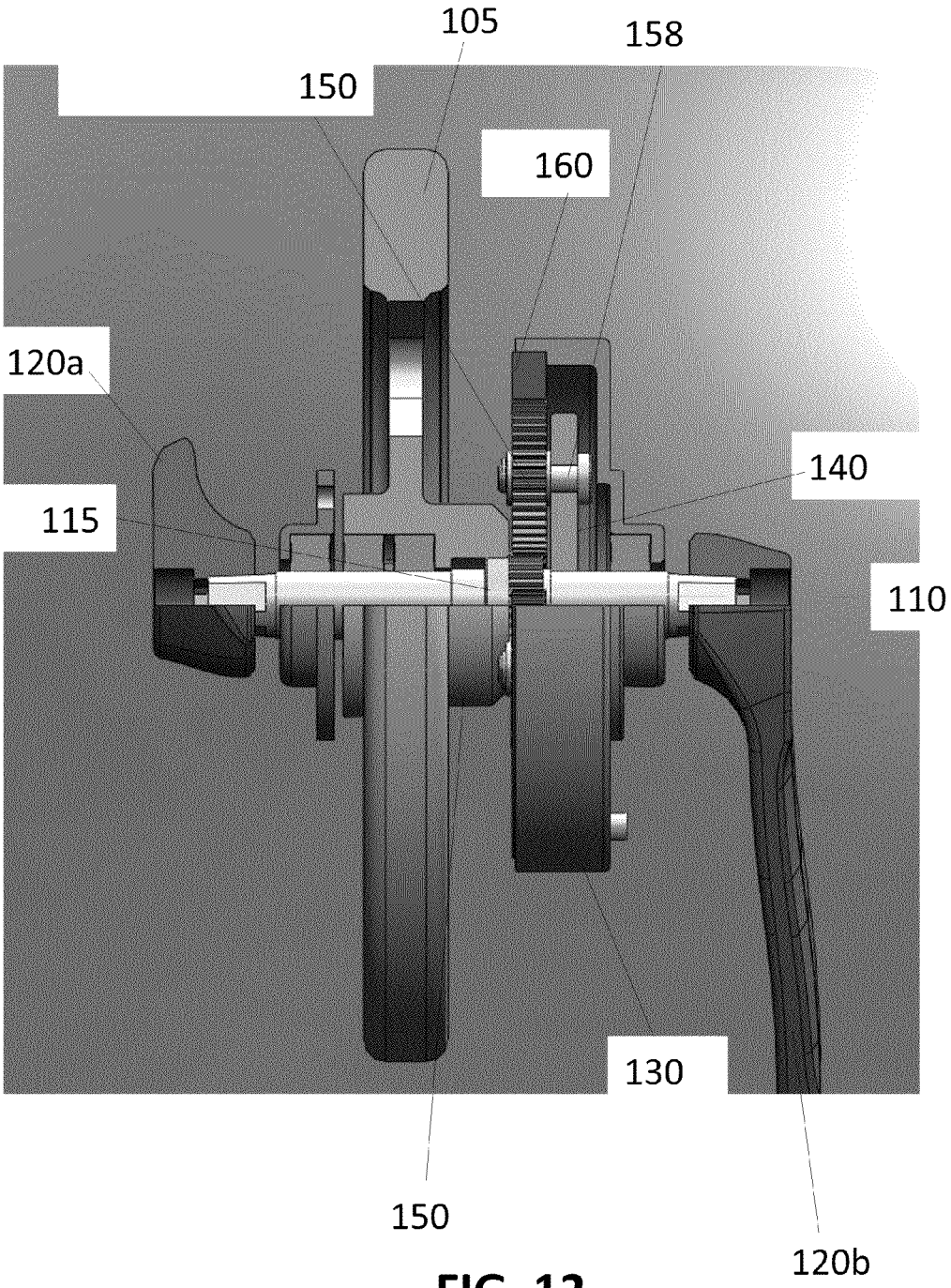
FIG. 12 is a side view of the alternative embodiment of the planetary gear system of FIG. 10.

As shown in FIG. 10-12, in some embodiments, the planet gears 150 are not compound gears (compound gears, e.g., the combination of the large planet gear wheels 152 and small planet gear wheels 151 as described above). As described above, the sun gear 115 is fixedly attached to the flywheel 105, and the planet carrier 140 is fixed to the axle shaft 110. One or more planet gear wheels 150 (e.g., two, three, four, five, six, etc.) are disposed on the planet carrier 140 (e.g., via planet gear wheel axles 158). The planet gear wheels 150 can rotate independently of the planet carrier 140. Disposed in the housing 130 surrounding the planet gear wheels 150 is the ring gear 160. The inner surface of the ring gear 160 engages the outer surfaces of the planet gear wheels 150. The planet gear wheels 150 are positioned such that their outer surfaces engage the sun gear 115 (e.g., see FIG. 11). When the cranks 120 and axle shaft 110 rotate in a first direction, the planet carrier 140 in turn rotates in the first direction. This causes the planet gear wheels 150 to rotate in the second direction within the ring gear 160. Rotation of the planet gear wheels 150 in the second direction drives the rotation of the sun gear 115 and flywheel 105 in the first direction.

The system 100 of the present invention provides a speed increase ratio. As used herein, the term "speed increase ratio" refers to the number of rotations of the heel 105 compared to the number of rotations of the cranks 120. For example, a speed increase ratio of 11:1 refers to 11 rotations of the flywheel 105 per 1 rotation of the cranks 120.

In some embodiments, the speed increase ratio is between about 1:1 to about 20:1. In some embodiments, the speed increase ratio is at least about 1:1. In some embodiments, the speed increase ratio is about 11:1. In some embodiments, the speed increase ratio is about 2:1. In some embodiments, the speed increase ratio is about 5:1. In some embodiments, the speed increase ratio is about 8:1. In some embodiments, the speed increase ratio is about 10:1. In some embodiments, the speed increase ratio is about 12:1. In some embodiments, the speed increase ratio is about 15:1. In some embodiments, the speed increase ratio is about 20:1. In some embodiments, the speed increase ratio is at least about 20:1.

Figure 5:
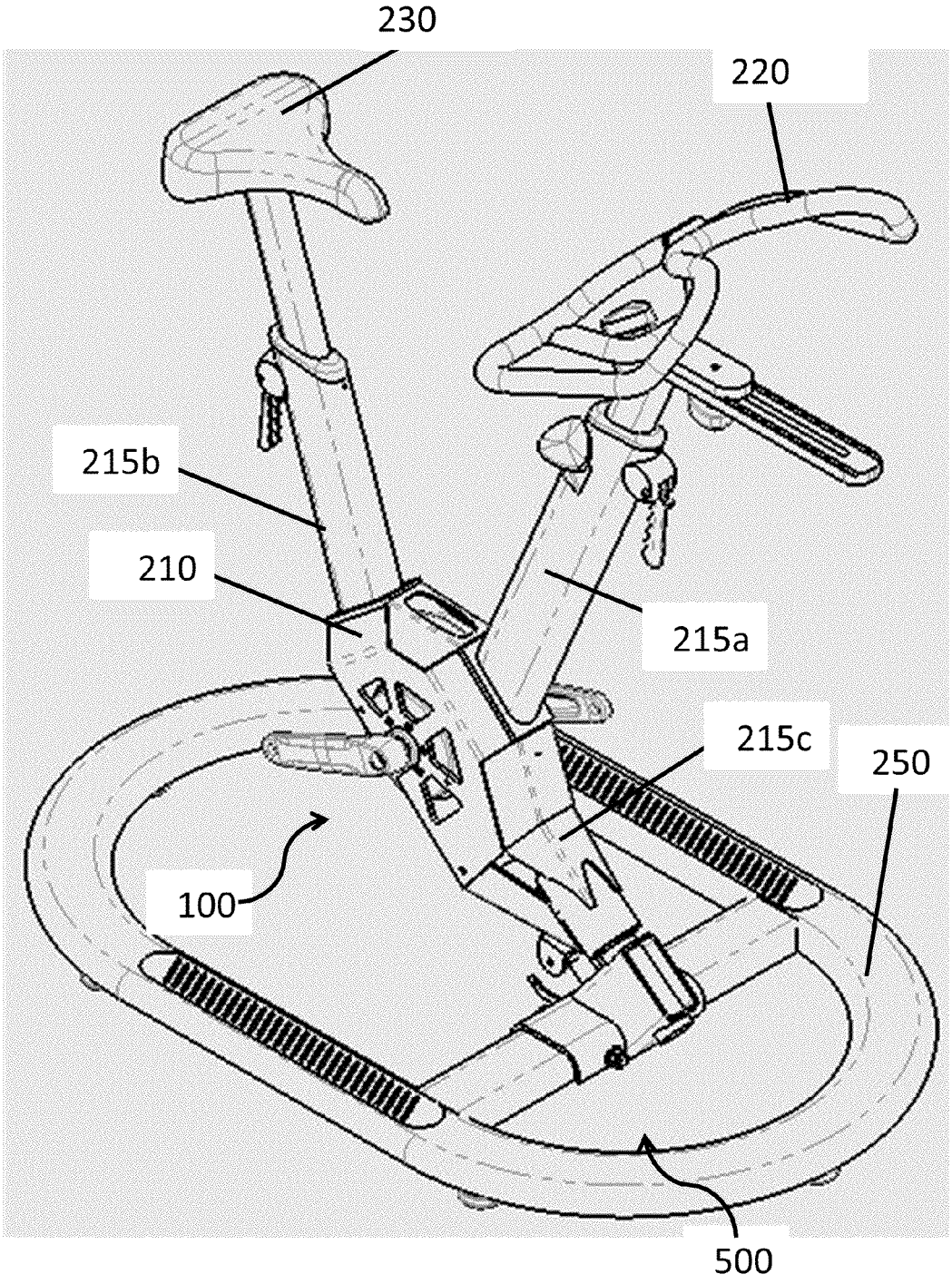
FIG. 5 is an in-use view of the planetary gear system of the present invention and the rolling recoiled lateral motion system of the present invention.
Figure 6:
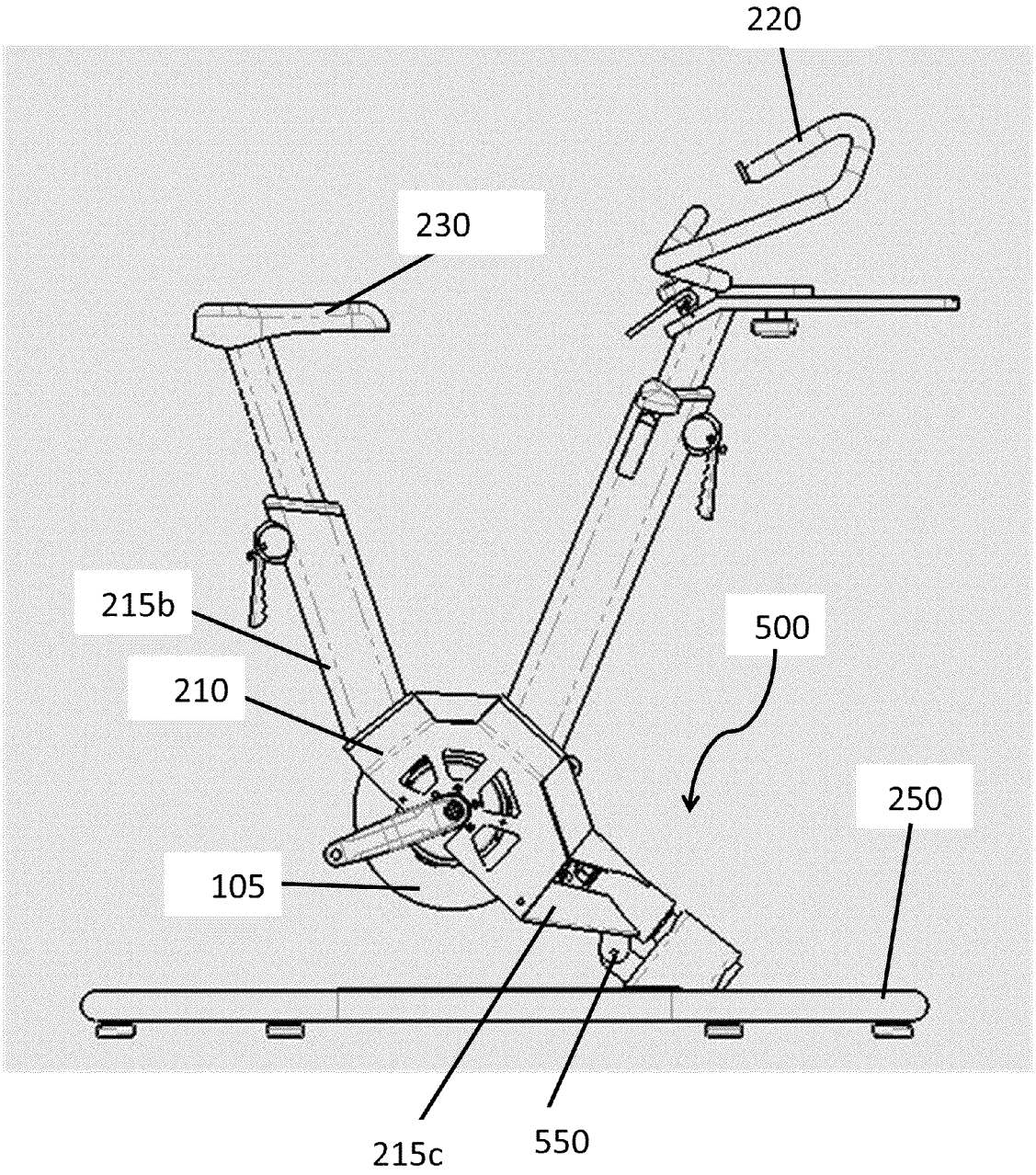
FIG. 6 is a side view of the systems in FIG. 5.
Figure 7:
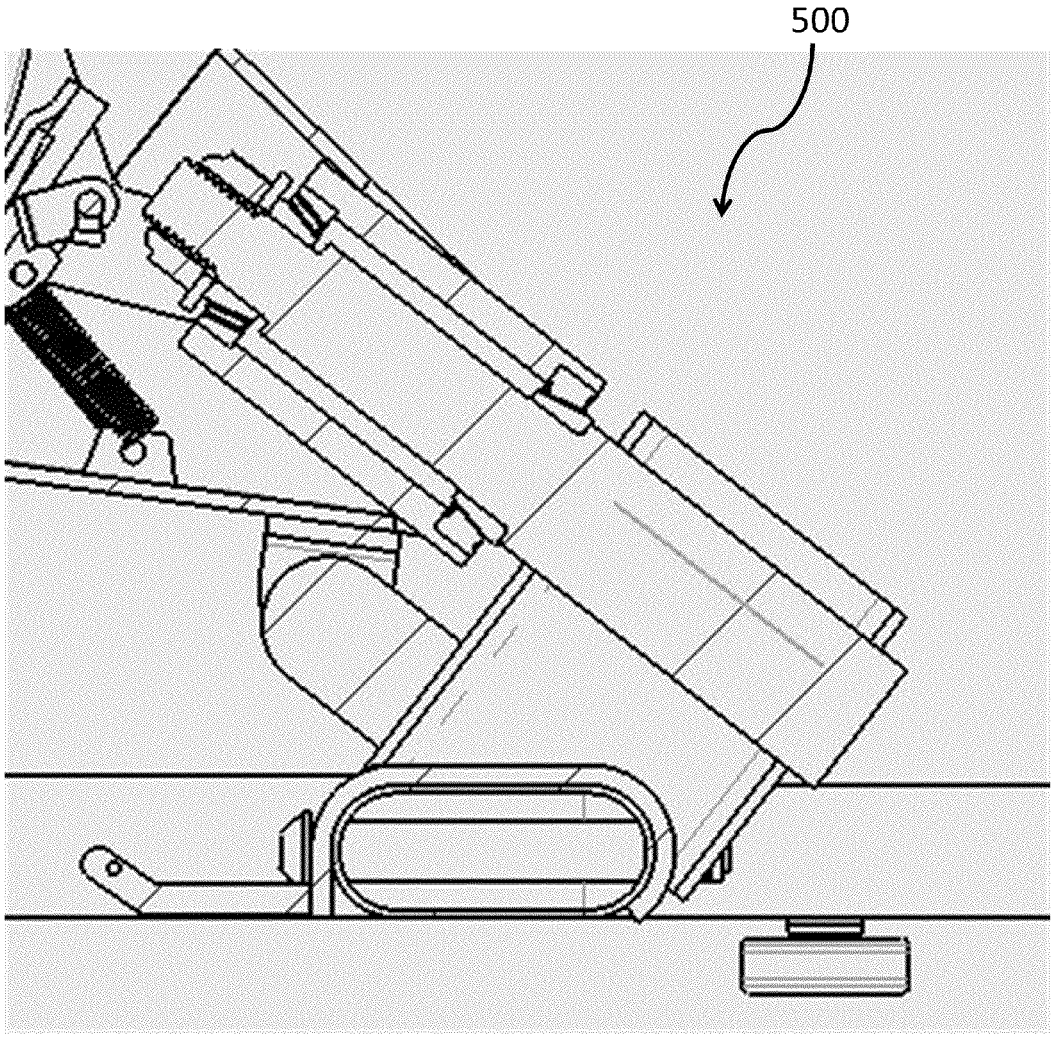
FIG. 7 is a detailed side view of the rolling recoiled lateral motion system of FIG. 6.
Figure 8:
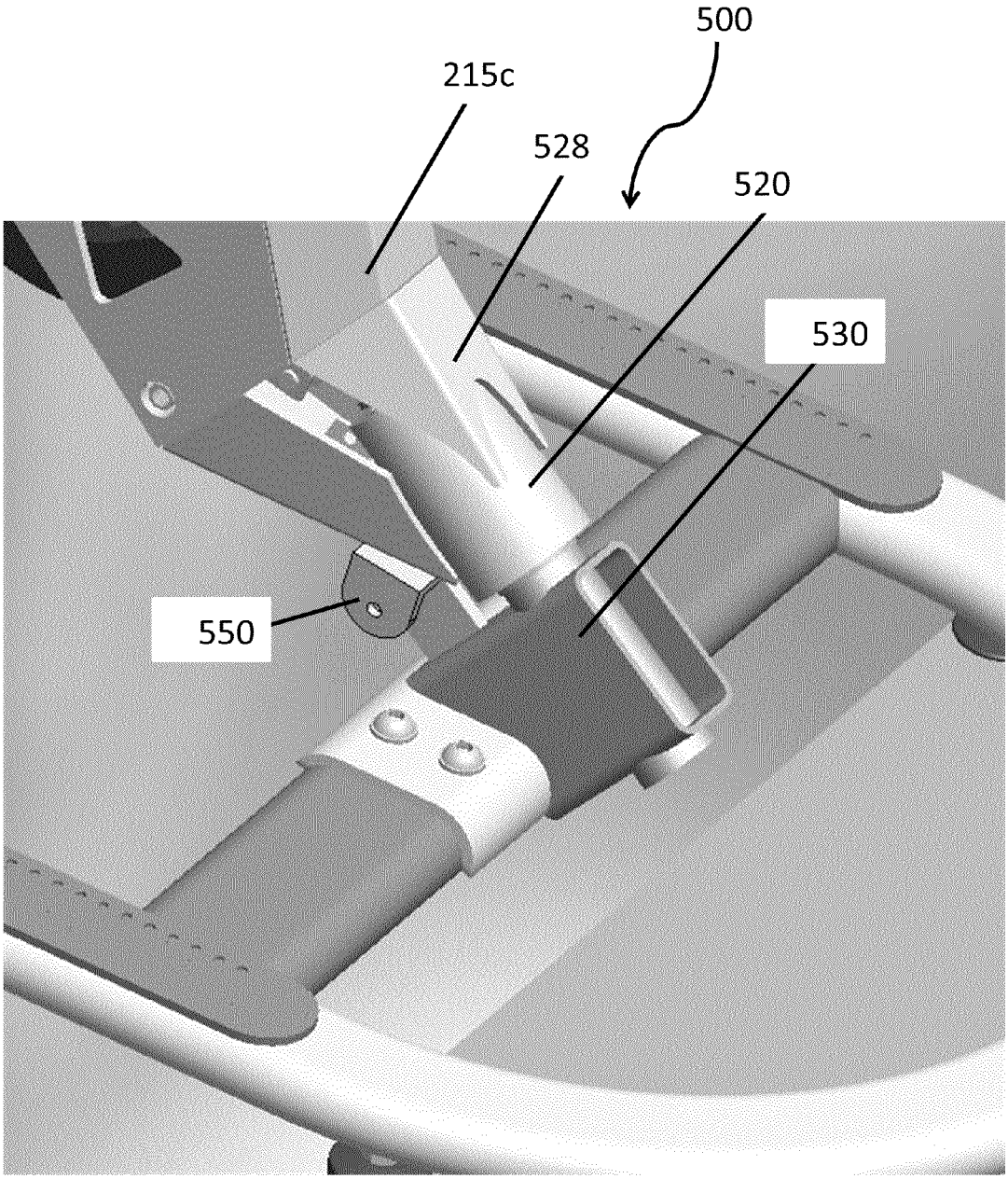
FIG. 8 is a detailed perspective view of the rolling recoiled lateral motion system of the present invention.

Generally, the system 100 of the present invention is used in exercise equipment, for example a stationary bicycle system. As shown in FIG. 5, the system is integrated into a bicycle frame 210. The housing 130 is fixed to the frame 210 (or in the frame 210), providing support and resistance against which the cranks and axle shaft 110 can rotate. As in standard stationary bicycles, the bicycle system may comprise a handlebar system 220 and a seat system 230. In some embodiments, the bicycle frame 210 comprises a first extension 215*a* extending from the vertex adapted to support the handlebar system 220. In some embodiments, the bicycle frame 210 comprises a second extension 215*b* extending from the vertex adapted to support the seat system 230. The handlebar system 220 and seat system 230 may be various configurations and systems including but not limited to standard handlebar systems and seat systems well known to one of ordinary skill in the art. This system of the present invention may also be used in a "recumbent" style bike, in which the user is situated in a seat or saddle substantially behind the pedal crank set, rather than above them. The user is seated in a chair-like arrangement, and the frame of the bike is designed to accommodate such a position, with handlebars, seat backrest, and other features suitable arranged.

As shown in FIG. 5, the stationary bicycle system comprises a base 250 to which the bicycle frame 210 is attached. In some embodiments, the base 250 is generally oval in shape, however the base 250 is not limited to this shape (e.g., the base 250 may be circular in shape, rectangular in shape, H-shaped, I shaped, X shaped, etc.). The bicycle frame 210 may comprise a lower extension 215*c* extending from the vertex that connects to the base 250. In some embodiments, a bicycle frame 210 has a lower extension 215*c* extending from the vertex of the bicycle frame 210. In some embodiments, the rotational bearing 520*a* rotatably engages the lower extension 215. In some embodiments, the bicycle frame 210 can rotate right or left with respect to the base 250. In some embodiments, the planetary gear system is integrated into the bicycle frame 210 at the vertex of the bicycle frame 210. In some embodiments, the bicycle frame 210 is solely suspended from the lower extension 215*c* adjacent to the planetary gear system. In some embodiments, the base 250 is only attached to the bicycle frame 210 at a single point via the rotational bearing 520*a* and the lower extension 215*c*.

In some embodiments, the ring gear 160 (e.g., with teeth on the inside diameter) may be replaced by a gear with teeth on the outside diameter, mounted on the same axis. The ring gear 160 would still engage or mesh with the planet gear 140, but on the side of the planet facing toward the axle shaft 110 (instead of the side facing opposite the axle shaft 110 as described above). This arrangement causes the planet gear wheels 150 to turn in the same rotational direction as the planet carrier 140, and the sun gear 115 turns in the opposite rotational direction.

In some embodiments, the planet carrier 140 is rigidly attached to the frame supports (e.g., the two housings 130, 130*a*; the two housings 130, 130*a* may be supported by bearings 180*b*), and the ring gear 160 is fixedly attached to the axle shaft 110. In this configuration, the planet carrier 140 is fixed and does not rotate, and therefore the planet gear wheels 150 do not orbit around the main axle shaft 110. When the cranks 120 are rotated, the ring gear 160 rotates, too (the ring gear 160 is fixedly attached to the axle shaft 110), causing the planet gear wheels 150 to rotate around their respective planet gear wheel axles 158. The planet gear wheels 150, being engaged with (in mesh with) the sun gear 115, causes the sun gear 115 to rotate, and therefore the flywheel 150 rotates because the flywheel 105 is fixedly attached to the sun gear 115.

Without wishing to limit the present invention to any theory or mechanism, it is believed that the planetary gear system 100 of the present invention is advantageous because it eliminates a need for adjustment of a chain or belt. For example, many exercise bicycles use a chain or a belt drive system to transfer the rotary motion of the pedals and cranks to a flywheel. Both belts and chains often require a way to adjust the center distance (the distance between the driver and the driven axles) to keep the system working properly. A belt that is too loose will slip, and cause a loss of transferred energy and torque. Similarly, a chain that is too loose will skip teeth, make noise, or even come completely off the chain rings. Conversely, if the chain or belt is too tight, it can cause pre-mature wear and breakage. Both chains and belts can stretch out and wear over time and usage, causing the need to adjust them periodically during their useful life. This costs the owner time and money. Because the system 100 of the present invention does not utilize a belt or chain, no adjustment is needed for proper operation, eliminating the need for periodic maintenance or failures due to lack of maintenance. Also, because of the compact nature of the planetary gear system 100, there are no exposed external moving parts to get fouled or caught, as a chain drive is prone to do.

Without wishing to limit the present invention to any theory or mechanism, it is believed that the planetary gear system 100 of the present invention is advantageous because it allows for a higher gear ratio. For example, many exercise bicycles have a belt or chain drive to transfer rotary motion from the pedal crank axle to the flywheel. The purpose of having a flywheel on an exercise bike is to add rotational inertia to the drive system, providing the user with a feeling of resistance when he accelerates, and maintaining the speed of the system when the user is not applying pedal force (such as at the top and bottom of each pedal stroke). The physical inertia of the flywheel is determined by its weight and configuration. The amount of inertia the rider feels at the pedal crank axle is determined by the motion ratio (or gear ratio as it may be called) between the pedal crank and the flywheel. For a fixed weight flywheel, the higher the gear ratio, the higher the inertia felt at the pedals. Most chain driven exercise bicycles are limited to a gear ratio of about 3.25:1 by the practical size of the pedal crank chainring size and the flywheel chainring size. With this ratio, a flywheel of approximately 45 lbs and 20 inches in diameter must be used to comfortably simulate an acceptable amount of pedal inertia. The planetary gear system of the present invention can achieve a much higher gear ratio in a smaller, more compact space. With a gear ratio of 11:1, for example, the required weight of the flywheel is only about 8 lbs and 12 inches in diameter, to have the same pedal inertia feel as a chain driven bike with a 45 lb flywheel. This is an advantage for many things, including manufacturing cost, shipping, and mobility of the bike.

Without wishing to limit the present invention to any theory or mechanism, it is believed that the planetary gear system 100 of the present invention is advantageous because the co-axial operation of cranks and flywheel is compact and allows for design freedom. For example, many exercise bicycles have a belt or chain drive to transfer rotary motion from the pedal crank axle to the flywheel. The required center distance between the pedal crank axle and flywheel axle may be greater than 18 inches, making the whole drivetrain with a 20 inch flywheel bulky and requiring a rigid frame to support two sets of bearings for the two axles. By locating the flywheel and the pedal cranks on the same axle as in the system 100 of the present invention, the entire drivetrain package can be made much more compact. The frame only needs to support only one set of bearings. And with a smaller flywheel allowed by the higher gear ratio as described above, the entire drivetrain, including cranks, transmission, and flywheel, can be made in a 12 inch diameter circular space. This is an advantage because of the freedom it allows in design options for the frame configuration, taking up much less space and allowing for new and different shapes for the product design.

Without wishing to limit the present invention, it is believed that the system 100 is advantageous because it allows for the flywheel 105 to spin at a greater speed. This speed and energy can be harnessed for other purposes.

The system of the present invention may be constructed from a variety of materials. Examples of materials may include but are not limited to metals and/or metal alloys (e.g., stainless steel, titanium, aluminum, carbon steel, etc.), rubbers, plastics, the like, or a combination thereof.

Rolling Recoiled Lateral Motion System

Referring now to FIG. 5-9, the present invention also features a rolling recoiled lateral motion system 500. The rolling recoiled lateral motion system 500 allows for lateral, side-to-side, and rolling motion to be achieved, which feels similar to the natural motions when riding a bicycle into a turn or when standing up (e.g., for a sprint).

The rolling recoiled lateral motion system 500 of the present invention comprises a rotational bearing 520*a* rotatably engaged in the lower extension 215*c* of the bicycle frame 210 (e.g., a sleeve 520 in the lower extension 215*c* supported by a support component 528). The rotational bearing 520*a* can rotate within the sleeve 520. The rotational bearing 520*a* is attached to the base 250 at an angle A (e.g., angle A is the angle formed between the plane of the base 250 and the rotational bearing 520*a*). In some embodiments, the rotational bearing 520*a* is attached to the base 250 via a reinforced frame support 530.

In some embodiments, angle A is between about 30 to 50 degrees. In some embodiments, angle A is between about 20 to 40 degrees. In some embodiments, angle A is between about 40 to 60 degrees.

The system 500 allows the bicycle frame 210 to rotate right or left with respect to the base 250 (e.g., towards a right side of the base 250 or towards a left side of the base 250). The system 500 comprises a recoil support mechanism 550 is provided to limit this rotational movement (e.g., to a few degrees). This recoil support mechanism 550 helps return the bicycle (e.g., frame 210) to its normal upright vertical orientation. As a result, should the bottom of the bicycle (e.g., frame 210) move too far to the left, the recoil support mechanism helps return the bicycle (e.g., frame 210) back to the right and vice versa. In some embodiments, the recoil support mechanism 550 comprises a first bumper 610*a* and a second bumper 610*b* positioned on opposite sides of the bicycle frame 210 (or on opposite sides of a recoil support gusset 620 on the bicycle frame 210), or a first spring and a second spring positioned on opposite sides of the bicycle frame 210 (or a recoil support gusset on the bicycle frame 210). The bumpers 610 or springs provide a return to center force.

The bumpers 610 or springs can move between at least an extended position and a compressed position. Rotational movement of the bicycle frame causes the recoil support gusset 620 to compress the bumpers 610 or springs to the compressed position. Because the bumpers 610 or springs are biased in the extended position, the bumpers 610 or springs in turn push back against the recoil support gusset to limit rotational movement about the axis.

In some embodiments, the system 500 comprises a locking mechanism (e.g., the locking mechanism is integrated into the pivot system) adapted to allow a user to prevent the bike frame from pivoting. For example, a user may wish to lock the pivoting system while getting on and off the bike, or to ride with it locked to vary the feeling of the workout. In some embodiments, the locking system may be actuated by the user via an appropriate control switch or handle, and may prevent the bike frame from rotating around the pivot axle, keeping the frame stationary.

Figure 9:
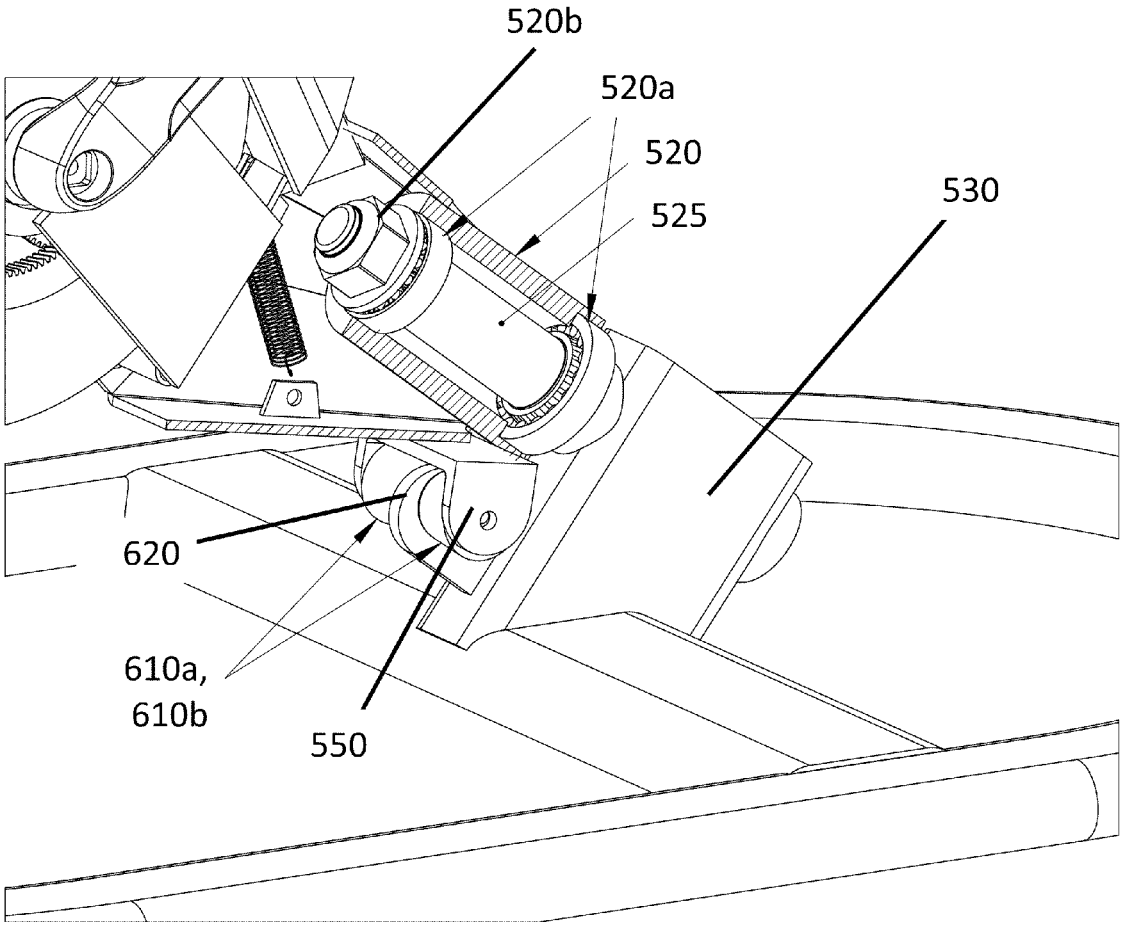
FIG. 9 is a detailed perspective view of the rolling recoiled lateral motion system of the present invention.

FIG. 9 shows the pivot sleeve 520 being a part of the main frame. The sleeve 520 receives the pivot bearings 520*a*. The nut 520*b* helps keep the bearings in place and helps prevent the sleeve 520 from slipping. The pivot shaft 525 shown provides an axle shaft around which the frame can rotate. The recoil support mechanism 550 is attached (e.g., welded) to the frame and moves with the frame. In some embodiments, the pivot shaft and the sleeve are reversed from what is shown (e.g., the sleeve may be part of the base).

As used herein, the term "about" refers to plus or minus 10% of the referenced number. For example, an embodiment wherein the diameter of the flywheel 105 is about 10 inches includes a diameter that is between 9 and 11 inches.

The disclosures of the following U.S. Patents are incorporated in their entirety by reference herein: U.S. Pat. No. 3,964,742; U.S. Pat. No. 4,272,094; U.S. Pat. No. 4,309,043; U.S. Pat. No. 4,632,386; U.S. Pat. No. 4,712,806; U.S. Pat. No. 4,880,224; U.S. Pat. No. 5,031,902; U.S. Pat. No. 5,480,366; U.S. Pat. No. 7,163,491; U.S. Pat. No. 2006/0217237; U.S. Pat. No. 2008/0051258; U.S. Pat. No. 2009/10036276.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The reference numbers recited in the below claims are solely for ease of examination of this patent application, and are exemplary, and are not intended in any way to limit the scope of the claims to the particular features having the corresponding reference numbers in the drawings.

What is claimed is:

1. An exercise system comprising:

(i) a planetary gear system comprising:

(a) a flywheel (105);

(b) an axle shaft (110) having a first end and a second end, the axle shaft (110) is disposed through a center (106) of the flywheel (105), the flywheel (105) rotates independently of the axle shaft (110);

(c) a sun gear (115) disposed around the axle shaft (110) and fixedly attached to the flywheel (105), the sun gear (115) rotates independently of the axle shaft (110);

(d) a first crank (120*a*) and a second crank (120*b*) fixedly attached to the first end and the second end of the axle shaft (110), respectively;

(f) a planet carrier (140) fixedly attached to the axle shaft (110);

(g) a ring gear (160);

(h) at least one planet gear wheel (150) rotatably attached to the planet carrier (140), the planet gear wheel (150) can rotate independently of the planet carrier (140), an outer surface of the planet gear wheel (150) engages both an inner surface of the ring gear (160) and an outer surface of the sun gear (115), wherein rotation of the axle shaft (110) in a first direction via the cranks (120) in turn rotates the planet carrier (140) in the first direction, thereby causing the planet gear wheel (150) to rotate in a second direction within the ring gear, rotation of the planet gear wheel (150) in the second direction causes the sun gear (115) and the flywheel (105) to together rotate in the first direction; and (ii) a pivot system comprising:

(a) a base (250);

(b) a rotational bearing (520*a*) attached to the base (250) at an angle A, wherein angle A is between 30 to 50 degrees with respect to a plane of the base (250);

(c) a bicycle frame (210) having a first handlebar support extension (215*a*) extending from a vertex of the bicycle frame (210), a second seat support extension (215*b*) extending from the vertex of the bicycle frame (250), and a lower extension (215*c*) disposed at a vertex of the bicycle frame (210), wherein the first handlebar support extension (215*a*), the second seat support extension (215*b*), and the lower extension (215*c*) intersect the vertex of the bicycle frame (210), wherein the rotational bearing (520*a*) rotatably engages the lower extension (215), wherein the bicycle frame (210) can rotate right or left with respect to the base (250), the planetary gear system (100) is integrated into the bicycle frame (210) at the vertex of the bicycle frame (210), wherein the bicycle frame (210) is solely suspended from the lower extension (215*c*) adjacent to the planetary gear system; and (d) a recoil support mechanism (550), wherein the recoil support mechanism (550) comprises a first bumper (610*a*) or a first spring and a second bumper (610*b*) or a second spring disposed on and facing opposite sides of a planar recoil support gusset (620), wherein the recoil support gusset (620) is disposed perpendicular to the plane of the base (250), wherein the recoil support mechanism (550) is adapted to limit rotational movement of the bicycle frame (210) with respect to the base (250);

wherein the base (250) is only attached to the bicycle frame (210) at a single point via the rotational bearing (520*a*) and the lower extension (215*c*).

2. The system (100) of claim 1, wherein the planet carrier (140) is attached to the axle shaft (110) in at least one rotational direction.

3. An exercise system consisting of:

(i) a planetary gear system consisting of:

(a) a flywheel (105);

(b) an axle shaft (110) having a first end and a second end, the axle shaft (110) is disposed through a center (106) of the flywheel (105), the flywheel (105) rotates independently of the axle shaft (110);

(c) a sun gear (115) disposed around the axle shaft (110) and fixedly attached to the flywheel (105), the sun gear (115) rotates independently of the axle shaft (110);

(d) a first crank (120*a*) and a second crank (120*b*) fixedly attached to the first end and the second end of the axle shaft (110), respectively;

(f) a planet carrier (140) fixedly attached to the axle shaft (110);

(g) a ring gear (160);

(h) at least one planet gear wheel (150) rotatably attached to the planet carrier (140), the planet gear wheel (150) can rotate independently of the planet carrier (140), an outer surface of the planet gear wheel (150) engages both an inner surface of the ring gear (160) and an outer surface of the sun gear (115), wherein rotation of the axle shaft (110) in a first direction via the cranks (120) in turn rotates the planet carrier (140) in the first direction, thereby causing the planet gear wheel (150) to rotate in a second direction within the ring gear, rotation of the planet gear wheel (150) in the second direction causes the sun gear (115) and the flywheel (105) to together rotate in the first direction; and (ii) a pivot system consisting of:

(a) a base (250);

(b) a rotational bearing (520*a*) attached to the base (250) at an angle A;

(c) a bicycle frame (210) having a first handlebar support extension (215*a*) extending from a vertex of the bicycle frame (210), a second seat support extension (215*b*) extending from the vertex of the bicycle frame (250), and a lower extension (215*c*) disposed at a vertex of the bicycle frame (210), wherein the first handlebar support extension (215*a*), the second seat support extension (215*b*), and the lower extension (215*c*) intersect the vertex of the bicycle frame (210), wherein the rotational bearing (520*a*) rotatably engages the lower extension (215), wherein the bicycle frame (210) can rotate right or left with respect to the base (250), the planetary gear system (100) is integrated into the bicycle frame (210) at the vertex of the bicycle frame (210), wherein the bicycle frame (210) is solely suspended from the lower extension (215*c*) adjacent to the planetary gear system; and (d) a recoil support mechanism (550), wherein the recoil support mechanism (550) consists of a first bumper (610*a*) or a first spring and a second bumper (610*b*) or a second spring disposed on and facing opposite sides of a planar recoil support gusset (620), wherein the recoil support gusset (620) is disposed perpendicular to the plane of the base (250), wherein the recoil support mechanism (550) is adapted to limit rotational movement of the bicycle frame (210) with respect to the base (250);

wherein the base (250) is only attached to the bicycle frame (210) at a single point via the rotational bearing (520*a*) and the lower extension (215*c*).

* * * * *